US009119445B2

(12) United States Patent
Humbert et al.

(10) Patent No.: US 9,119,445 B2
(45) Date of Patent: Sep. 1, 2015

(54) BUCKLE ASSEMBLIES WITH LIFT LATCHES AND ASSOCIATED METHODS AND SYSTEMS

(71) Applicant: AmSafe, Inc., Phoenix, AZ (US)

(72) Inventors: Todd J. Humbert, Chandler, AZ (US); David T. Merrill, Scottsdale, AZ (US)

(73) Assignee: AmSafe, Inc., Phoenix, AZ (US)

( * ) Notice: Subject to any disclaimer, the term of this patent is extended or adjusted under 35 U.S.C. 154(b) by 0 days.

(21) Appl. No.: 14/183,478

(22) Filed: Feb. 18, 2014

(65) Prior Publication Data

US 2014/0230202 A1 Aug. 21, 2014

Related U.S. Application Data

(60) Provisional application No. 61/766,681, filed on Feb. 19, 2013.

(51) Int. Cl.
*B60R 22/12* (2006.01)
*A44B 11/25* (2006.01)

(52) U.S. Cl.
CPC ..... *A44B 11/253* (2013.01); *Y10T 24/4566* (2015.01); *Y10T 29/49826* (2015.01)

(58) Field of Classification Search
CPC .. B60R 22/12; A44B 11/253; A44B 11/2526; A44B 11/2542; Y10T 24/45084; Y10T 24/45607; Y10T 24/45613; Y10T 24/45618; Y10T 24/45628; Y10T 24/45634
USPC ..... 24/579.11, 632, 631, 635, 630, 634; 280/801.1
See application file for complete search history.

(56) References Cited

U.S. PATENT DOCUMENTS

| | | | |
|---|---|---|---|
| 906,045 | A | 12/1908 | Miller |
| 1,079,080 | A | 11/1913 | Ward |
| 1,369,456 | A | 2/1922 | Meredith |
| 1,438,898 | A | 12/1922 | Carpmill |
| 1,816,262 | A | 7/1931 | Ritter |
| 1,930,378 | A | 10/1933 | Beagan |
| 2,132,556 | A | 10/1938 | Blackshaw |

(Continued)

FOREIGN PATENT DOCUMENTS

| | | |
|---|---|---|
| CA | 2038505 | 9/1991 |
| CA | 2091526 | 10/1993 |

(Continued)

OTHER PUBLICATIONS

Britax, "COMPAQ: Convertible Car Seats." Buckle Image. Accessed Oct. 12, 2010. (2 pages). This has been publicly available for at least one year prior to this application's filing date.

(Continued)

*Primary Examiner* — Robert J Sandy
*Assistant Examiner* — Rowland Do
(74) *Attorney, Agent, or Firm* — Perkins Coie LLP

(57) ABSTRACT

Buckle assemblies with lift latches and associated systems and methods are disclosed herein. In one embodiment, a buckle assembly is configured to detachably engage at least one latch plate. The buckle assembly includes a cover, a load plate connected to the cover and formed with a plurality of openings, a shaft passing through the cover, a lift latch being operably rotated around the shaft in the operation space, and pawls selectively locking corresponding latch plates inserted in the openings in response to the rotation of the lift latch.

15 Claims, 8 Drawing Sheets

(56) References Cited

U.S. PATENT DOCUMENTS 2,255,258 A * 9/1941 Lethern et al. ..... 24/579.11
2,372,557 A 3/1945 Dowd
2,393,178 A * 1/1946 Manson ..... 24/632
2,437,585 A 3/1948 Zimmern
2,482,693 A 9/1949 Rogers et al.
2,538,641 A 1/1951 Elsner
2,549,841 A 4/1951 Morrow et al.
2,639,852 A 5/1953 Sanders et al.
2,641,813 A 6/1953 Loxham
2,668,997 A * 2/1954 Irvin et al. ..... 24/632
2,710,999 A 6/1955 Davis
2,763,451 A 9/1956 Moran
2,803,864 A 8/1957 Bishaf
2,845,233 A 7/1958 Wrighton
2,846,745 A 8/1958 Lathrop
2,869,200 A 1/1959 Phillips et al.
2,876,516 A 3/1959 Cummings
2,892,232 A 6/1959 Quilter
2,893,088 A 7/1959 Harper et al.
2,899,732 A 8/1959 Cushman
2,901,794 A 9/1959 Prete, Jr.
2,921,353 A * 1/1960 Cushman ..... 24/632
2,938,254 A 5/1960 Gaylord
2,964,815 A 12/1960 Sereno
2,965,942 A 12/1960 Carter
3,029,487 A 4/1962 Asai
3,034,596 A * 5/1962 Twaits, Jr. ..... 182/3
3,084,411 A 4/1963 Lindblad
3,091,010 A 5/1963 Davis
3,104,440 A 9/1963 Davis
3,110,071 A 11/1963 Higuchi
3,118,208 A 1/1964 Wexler
3,137,907 A 6/1964 Unai
D198,566 S 7/1964 Holmberg et al.
3,142,103 A 7/1964 Lindblad
3,142,968 A * 8/1964 Basham et al. ..... 405/186
3,145,442 A 8/1964 Brown
3,165,805 A 1/1965 Lower
3,178,226 A 4/1965 Lorwin
3,179,992 A 4/1965 Murphy, Sr.
3,183,568 A 5/1965 Gaylord
3,189,963 A 6/1965 Warner et al.
3,218,685 A 11/1965 Atumi
3,226,791 A 1/1966 Carter
3,233,941 A 2/1966 Selzer
3,256,576 A 6/1966 Klove, Jr. et al.
3,262,169 A 7/1966 Jantzen
3,287,062 A 11/1966 Board
3,289,261 A 12/1966 Davis
3,293,713 A 12/1966 Gaylord
3,306,662 A 2/1967 Finnigan
3,312,502 A 4/1967 Coe
3,369,842 A 2/1968 Adams et al.
3,380,776 A 4/1968 Dillender
3,414,947 A 12/1968 Holmberg et al.
3,428,029 A 2/1969 Klickstein
3,451,720 A 6/1969 Makinen
3,491,414 A 1/1970 Stoffel
3,505,711 A 4/1970 Carter
3,523,342 A 8/1970 Spires
D218,589 S 9/1970 Lorhr et al.
3,564,672 A 2/1971 McIntyre
3,576,056 A 4/1971 Barcus
3,591,900 A 7/1971 Brown
3,605,207 A 9/1971 Glauser et al.
3,605,210 A 9/1971 Lohr
3,631,571 A 1/1972 Stoffel
3,639,948 A 2/1972 Sherman
3,644,967 A 2/1972 Romanzi, Jr. et al.
3,648,333 A 3/1972 Stoffel
3,658,281 A 4/1972 Gaylord
3,673,645 A 7/1972 Burleigh et al.
3,678,542 A 7/1972 Prete, Jr.
3,695,696 A 10/1972 Lohr et al.
3,714,684 A 2/1973 Gley
3,744,102 A 7/1973 Gaylord
3,744,103 A 7/1973 Gaylord
3,747,167 A * 7/1973 Pravaz ..... 24/573.11
3,760,464 A 9/1973 Higuchi
3,766,611 A 10/1973 Gaylord
3,766,612 A 10/1973 Hattori
3,775,813 A 12/1973 Higuchi
3,825,979 A 7/1974 Jakob
3,827,716 A 8/1974 Vaughn et al.
3,856,351 A 12/1974 Garveys
3,879,810 A 4/1975 Prete, Jr. et al.
3,898,715 A 8/1975 Balder
3,935,618 A 2/1976 Fohl et al.
3,964,138 A 6/1976 Gaylord
3,986,234 A 10/1976 Frost et al.
3,995,885 A 12/1976 Plesniarski
4,018,399 A 4/1977 Rex
4,026,245 A 5/1977 Arthur
4,051,743 A 10/1977 Gaylord
4,095,313 A 6/1978 Piljay et al.
D248,618 S 7/1978 Anthony
4,100,657 A 7/1978 Minolla et al.
4,118,833 A 10/1978 Knox et al.
4,128,924 A 12/1978 Happel et al.
4,136,422 A 1/1979 Ivanov et al.
4,148,224 A 4/1979 Craig
4,181,832 A 1/1980 Ueda et al.
4,184,234 A 1/1980 Anthony et al.
4,185,363 A 1/1980 David
4,196,500 A 4/1980 Happel et al.
4,220,294 A 9/1980 DiPaola
4,228,567 A 10/1980 Ikesue et al.
4,239,260 A 12/1980 Hollowell
4,253,623 A 3/1981 Steger et al.
4,262,396 A 4/1981 Koike et al.
4,273,301 A 6/1981 Frankila
4,302,049 A 11/1981 Simpson
4,317,263 A 3/1982 Fohl et al.
4,321,734 A 3/1982 Gandelman
4,334,341 A 6/1982 Krautz et al.
4,336,636 A 6/1982 Ishiguro et al.
4,366,604 A 1/1983 Anthony et al.
4,385,425 A 5/1983 Tanaka et al.
4,403,376 A * 9/1983 Palloks ..... 24/631
4,408,374 A 10/1983 Fohl et al.
4,419,874 A 12/1983 Brentini et al.
4,425,688 A 1/1984 Anthony et al.
4,457,052 A 7/1984 Hauber
4,487,454 A 12/1984 Biller
4,491,343 A 1/1985 Fohl et al.
4,525,901 A 7/1985 Krauss
4,545,097 A 10/1985 Wier et al.
4,549,769 A 10/1985 Pilarski
4,555,831 A 12/1985 Otzen et al.
4,569,535 A 2/1986 Haglund et al.
D285,383 S 9/1986 Anthony
4,617,705 A 10/1986 Anthony et al.
4,637,102 A 1/1987 Teder et al.
4,638,533 A 1/1987 Gloomis et al.
4,640,550 A 2/1987 Hakansson et al.
4,644,618 A 2/1987 Holmberg et al.
4,646,400 A 3/1987 Tanaka et al.
4,648,483 A 3/1987 Skyba
4,650,214 A 3/1987 Higbee
4,651,946 A 3/1987 Anthony et al.
4,656,700 A 4/1987 Tanaka et al.
4,660,889 A 4/1987 Anthony et al.
4,679,852 A 7/1987 Anthony et al.
4,682,791 A 7/1987 Ernst et al.
4,685,176 A 8/1987 Burnside et al.
4,692,970 A 9/1987 Anthony et al.
4,711,003 A 12/1987 Gelula
4,716,630 A 1/1988 Skyba
4,720,148 A 1/1988 Anthony et al.
4,726,625 A 2/1988 Bougher
4,727,628 A 3/1988 Rudholm et al.
4,733,444 A 3/1988 Takada
4,738,485 A 4/1988 Rumpf
4,741,574 A 5/1988 Weightman et al.

(56) References Cited

U.S. PATENT DOCUMENTS

| | | | |
|---|---|---|---|
| 4,742,604 | A | 5/1988 | Mazelsky |
| D296,678 | S | 7/1988 | Lortz et al. |
| 4,757,579 | A | 7/1988 | Nishino et al. |
| 4,758,048 | A | 7/1988 | Shuman |
| 4,766,654 | A | 8/1988 | Sugimoto |
| 4,786,078 | A | 11/1988 | Schreier et al. |
| 4,786,080 | A | 11/1988 | Jay |
| 4,790,597 | A | 12/1988 | Bauer et al. |
| 4,809,409 | A | 3/1989 | Van Riesen et al. |
| 4,832,410 | A | 5/1989 | Bougher |
| 4,843,688 | A | 7/1989 | Ikeda et al. |
| 4,854,607 | A | 8/1989 | Mandracchia et al. |
| 4,854,608 | A | 8/1989 | Barral et al. |
| D303,232 | S | 9/1989 | Lortz et al. |
| 4,876,770 | A | 10/1989 | Bougher |
| 4,876,772 | A | 10/1989 | Anthony et al. |
| 4,884,652 | A | 12/1989 | Vollmer |
| 4,901,407 | A | 2/1990 | Pandola et al. |
| 4,903,377 | A | 2/1990 | Doty |
| 4,911,377 | A | 3/1990 | Lortz et al. |
| 4,919,484 | A | 4/1990 | Bougher et al. |
| 4,927,211 | A | 5/1990 | Bolcerek |
| 4,934,030 | A | 6/1990 | Spinosa et al. |
| 4,940,254 | A | 7/1990 | Ueno et al. |
| 4,942,649 | A | 7/1990 | Anthony et al. |
| 4,995,640 | A | 2/1991 | Saito et al. |
| 5,015,010 | A | 5/1991 | Homeier et al. |
| 5,023,981 | A | 6/1991 | Anthony et al. |
| 5,026,093 | A | 6/1991 | Nishikaji |
| 5,029,369 | A | 7/1991 | Oberhardt et al. |
| 5,031,962 | A | 7/1991 | Lee |
| 5,038,446 | A | 8/1991 | Anthony et al. |
| 5,039,169 | A | 8/1991 | Bougher et al. |
| 5,046,687 | A | 9/1991 | Herndon |
| 5,050,274 | A | 9/1991 | Staniszewski et al. |
| 5,054,815 | A | 10/1991 | Gavagan |
| 5,058,244 | A | 10/1991 | Fernandez |
| 5,067,212 | A | 11/1991 | Ellis |
| 5,074,011 | A | 12/1991 | Carlson |
| 5,074,588 | A | 12/1991 | Huspen |
| 5,084,946 | A | 2/1992 | Lee |
| 5,088,160 | A | 2/1992 | Warrick |
| 5,088,163 | A | 2/1992 | van Riesen et al. |
| 5,097,572 | A | 3/1992 | Warrick |
| D327,455 | S | 6/1992 | Blair |
| 5,119,532 | A | 6/1992 | Tanaka et al. |
| 5,123,147 | A | 6/1992 | Blair |
| 5,123,673 | A | 6/1992 | Tame |
| 5,142,748 | A | 9/1992 | Anthony et al. |
| 5,159,732 | A | 11/1992 | Burke et al. |
| 5,160,186 | A | 11/1992 | Lee |
| 5,165,149 | A | 11/1992 | Nihei |
| 5,170,539 | A | 12/1992 | Lundstedt et al. |
| D332,433 | S | 1/1993 | Bougher |
| 5,176,402 | A | 1/1993 | Coulon |
| 5,182,837 | A | 2/1993 | Anthony et al. |
| 5,219,206 | A | 6/1993 | Anthony et al. |
| 5,219,207 | A | 6/1993 | Anthony et al. |
| 5,220,713 | A | 6/1993 | Lane, Jr. et al. |
| D338,119 | S | 8/1993 | Merrick |
| 5,234,181 | A | 8/1993 | Schroth et al. |
| 5,236,220 | A | 8/1993 | Mills |
| 5,248,187 | A | 9/1993 | Harrison |
| D342,465 | S | 12/1993 | Anthony et al. |
| 5,267,377 | A | 12/1993 | Gillis et al. |
| 5,269,051 | A | 12/1993 | McFalls |
| 5,272,770 | A | 12/1993 | Allen et al. |
| 5,282,672 | A | 2/1994 | Borlinghaus |
| 5,282,706 | A | 2/1994 | Anthony et al. |
| 5,283,933 | A | 2/1994 | Wiseman et al. |
| 5,286,057 | A | 2/1994 | Forster |
| 5,286,090 | A | 2/1994 | Templin et al. |
| 5,292,181 | A | 3/1994 | Dybro |
| 5,301,371 | A | 4/1994 | Chao |
| 5,306,044 | A * | 4/1994 | Tucker ..... 280/801.1 |
| 5,308,148 | A | 5/1994 | Peterson et al. |
| 5,311,653 | A | 5/1994 | Merrick |
| 5,332,968 | A | 7/1994 | Brown |
| 5,350,195 | A | 9/1994 | Brown |
| 5,350,196 | A | 9/1994 | Atkins |
| 5,369,855 | A | 12/1994 | Tokugawa et al. |
| 5,370,333 | A | 12/1994 | Lortz et al. |
| 5,375,879 | A | 12/1994 | Williams et al. |
| 5,380,066 | A | 1/1995 | Wiseman et al. |
| 5,392,535 | A | 2/1995 | Van Noy et al. |
| 5,397,171 | A | 3/1995 | Leach |
| 5,403,038 | A | 4/1995 | McFalls |
| 5,406,681 | A | 4/1995 | Olson et al. |
| 5,411,292 | A | 5/1995 | Collins et al. |
| 5,416,957 | A | 5/1995 | Renzi, Sr. et al. |
| D359,710 | S | 6/1995 | Chinni et al. |
| 5,432,987 | A | 7/1995 | Schroth |
| 5,435,272 | A | 7/1995 | Epstein |
| 5,443,302 | A | 8/1995 | Dybro |
| 5,451,094 | A | 9/1995 | Templin et al. |
| D364,124 | S | 11/1995 | Lortz et al. |
| 5,471,714 | A | 12/1995 | Olson et al. |
| 5,495,646 | A | 3/1996 | Scrutchfield et al. |
| 5,497,956 | A | 3/1996 | Crook |
| 5,511,856 | A | 4/1996 | Merrick et al. |
| 5,516,199 | A | 5/1996 | Crook et al. |
| 5,526,556 | A | 6/1996 | Czank |
| 5,540,403 | A | 7/1996 | Standley |
| 5,560,565 | A | 10/1996 | Merrick et al. |
| 5,561,891 | A | 10/1996 | Hsieh et al. |
| 5,566,431 | A | 10/1996 | Haglund |
| 5,568,676 | A | 10/1996 | Freeman |
| 5,570,933 | A | 11/1996 | Rouhana et al. |
| 5,579,785 | A | 12/1996 | Bell |
| 5,584,107 | A | 12/1996 | Koyanagi et al. |
| 5,588,189 | A | 12/1996 | Gorman et al. |
| 5,606,783 | A | 3/1997 | Gillis et al. |
| 5,622,327 | A | 4/1997 | Heath et al. |
| 5,628,548 | A | 5/1997 | Lacoste |
| 5,634,664 | A | 6/1997 | Seki et al. |
| 5,640,468 | A | 6/1997 | Hsu |
| 5,669,572 | A | 9/1997 | Crook |
| 5,695,243 | A | 12/1997 | Anthony et al. |
| 5,699,594 | A | 12/1997 | Czank et al. |
| D389,426 | S | 1/1998 | Merrick et al. |
| 5,722,689 | A | 3/1998 | Chen et al. |
| 5,743,597 | A | 4/1998 | Jessup et al. |
| 5,765,774 | A | 6/1998 | Maekawa et al. |
| 5,774,947 | A | 7/1998 | Anscher |
| 5,779,319 | A | 7/1998 | Merrick |
| D397,063 | S | 8/1998 | Woellert et al. |
| 5,788,281 | A | 8/1998 | Yanagi et al. |
| 5,788,282 | A | 8/1998 | Lewis |
| 5,794,878 | A | 8/1998 | Carpenter et al. |
| 5,806,148 | A | 9/1998 | McFalls et al. |
| 5,813,097 | A | 9/1998 | Woellert et al. |
| 5,839,793 | A | 11/1998 | Merrick et al. |
| 5,857,247 | A | 1/1999 | Warrick et al. |
| 5,873,599 | A | 2/1999 | Bauer et al. |
| 5,873,635 | A | 2/1999 | Merrick |
| 5,882,084 | A | 3/1999 | Verellen et al. |
| D407,667 | S | 4/1999 | Homeier |
| 5,908,223 | A | 6/1999 | Miller |
| 5,915,630 | A | 6/1999 | Step |
| 5,934,760 | A | 8/1999 | Schroth et al. |
| D416,827 | S | 11/1999 | Anthony et al. |
| 5,979,026 | A | 11/1999 | Anthony |
| 5,979,982 | A | 11/1999 | Nakagawa |
| 5,996,192 | A | 12/1999 | Haines et al. |
| 6,003,899 | A | 12/1999 | Chaney |
| 6,017,087 | A | 1/2000 | Anthony et al. |
| 6,056,320 | A | 5/2000 | Khalifa et al. |
| 6,065,367 | A | 5/2000 | Schroth et al. |
| 6,065,777 | A | 5/2000 | Merrick |
| 6,123,388 | A | 9/2000 | Vits et al. |
| 6,182,783 | B1 | 2/2001 | Bayley |
| RE37,123 | E | 4/2001 | Templin et al. |
| 6,224,154 | B1 | 5/2001 | Stoki |
| 6,230,370 | B1 | 5/2001 | Nelsen |

(56) References Cited

U.S. PATENT DOCUMENTS 6,260,884 B1 7/2001 Bittner et al.
6,295,700 B1 10/2001 Plzak
6,309,024 B1 10/2001 Busch
6,312,015 B1 11/2001 Merrick et al.
6,315,232 B1 11/2001 Merrick
6,322,140 B1 11/2001 Jessup et al.
6,322,149 B1 11/2001 Conforti et al.
6,325,412 B1 12/2001 Pan et al.
6,328,379 B1 12/2001 Merrick et al.
6,343,841 B1 2/2002 Gregg et al.
6,351,717 B2 2/2002 Lambrecht
6,357,790 B1 3/2002 Swann et al.
6,358,591 B1 3/2002 Smith
6,363,591 B1 4/2002 Bell et al.
6,367,882 B1 4/2002 Van Druff et al.
6,374,168 B1 4/2002 Fujii
6,400,145 B1 6/2002 Chamings et al.
6,412,863 B1 7/2002 Merrick et al.
6,418,596 B2 7/2002 Haas et al.
6,425,632 B1 7/2002 Anthony et al.
6,442,807 B1 9/2002 Adkisson
6,446,272 B1 9/2002 Lee et al.
6,463,638 B1 10/2002 Pontaoe
6,467,849 B1 10/2002 Deptolla et al.
6,485,057 B1 11/2002 Midorikawa et al.
6,485,098 B1 11/2002 Vits et al.
6,508,515 B2 1/2003 Vits et al.
6,513,208 B1 2/2003 Sack et al.
6,520,392 B2 2/2003 Thibodeau et al.
6,543,101 B2 4/2003 Sack et al.
6,547,273 B2 4/2003 Grace et al.
6,560,825 B2 5/2003 Maciejczyk et al.
6,566,869 B2 5/2003 Chamings et al.
6,588,077 B2 7/2003 Katsuyama et al.
6,592,149 B2 7/2003 Sessoms
6,606,770 B1 8/2003 Badrenas Buscart
6,619,753 B2 9/2003 Takayama
6,631,926 B2 10/2003 Merrick et al.
6,665,912 B2 12/2003 Turner et al.
6,694,577 B2 2/2004 Di Perrero et al.
6,711,790 B2 3/2004 Pontaoe
6,719,233 B2 4/2004 Specht et al.
6,719,326 B2 4/2004 Schroth et al.
6,722,601 B2 4/2004 Kohlndorfer et al.
6,722,697 B2 4/2004 Krauss et al.
6,733,041 B2 5/2004 Arnold et al.
6,739,541 B2 5/2004 Palliser et al.
6,749,150 B2 6/2004 Kohlndorfer et al.
6,763,557 B2 7/2004 Steiff et al.
6,769,157 B1 8/2004 Meal
6,786,294 B2 9/2004 Specht et al.
6,786,510 B2 9/2004 Roychoudhury et al.
6,786,511 B2 9/2004 Heckmayr et al.
6,793,291 B1 9/2004 Kocher
6,796,007 B1 9/2004 Anscher
6,802,470 B2 10/2004 Smithson et al.
6,820,310 B2 11/2004 Woodard et al.
6,820,902 B2 11/2004 Kim
6,834,822 B2 12/2004 Koning et al.
6,836,754 B2 12/2004 Cooper
6,837,519 B2 1/2005 Moskalik et al.
6,840,544 B2 1/2005 Prentkowski
6,851,160 B2 2/2005 Carver
6,857,326 B2 2/2005 Specht et al.
6,860,671 B2 3/2005 Schulz
6,863,235 B2 3/2005 Koning et al.
6,863,236 B2 3/2005 Kempf et al.
6,868,585 B2 3/2005 Anthony et al.
6,868,591 B2 3/2005 Dingman et al.
6,871,876 B2 3/2005 Xu
6,874,819 B2 4/2005 O'Neill
6,882,914 B2 4/2005 Gioutsos et al.
6,886,889 B2 5/2005 Vits et al.
6,896,291 B1 5/2005 Peterson
6,902,193 B2 6/2005 Kim et al.
6,913,288 B2 7/2005 Schulz et al.
6,916,045 B2 7/2005 Clancy, III et al.
6,921,136 B2 7/2005 Bell et al.
6,922,875 B2 8/2005 Sato et al.
6,931,669 B2 8/2005 Ashline
6,935,701 B1 8/2005 Arnold et al.
6,951,350 B2 10/2005 Heidorn et al.
6,957,789 B2 10/2005 Bowman et al.
6,959,946 B2 11/2005 Desmarais et al.
6,962,394 B2 11/2005 Anthony et al.
6,966,518 B2 11/2005 Kohlndorfer et al.
6,969,022 B2 11/2005 Bell et al.
6,969,122 B2 11/2005 Sachs et al.
6,993,436 B2 1/2006 Specht et al.
6,997,474 B2 2/2006 Midorikawa et al.
6,997,479 B2 2/2006 Desmarais et al.
7,010,836 B2 3/2006 Acton et al.
D519,406 S 4/2006 Merrill et al.
7,025,297 B2 4/2006 Bell et al.
7,029,067 B2 4/2006 Vits et al.
7,040,696 B2 5/2006 Vits et al.
7,065,843 B1 * 6/2006 Wu ..... 24/642
7,073,866 B1 7/2006 Berdahl
7,077,475 B2 7/2006 Boyle
7,080,856 B2 7/2006 Desmarais et al.
7,083,147 B2 8/2006 Movsesian et al.
7,100,991 B2 9/2006 Schroth et al.
7,108,114 B2 9/2006 Mori et al.
7,118,133 B2 10/2006 Bell et al.
7,131,667 B2 11/2006 Bell et al.
7,137,648 B2 11/2006 Schulz et al.
7,137,650 B2 11/2006 Bell et al.
7,140,571 B2 11/2006 Hishon et al.
7,144,085 B2 12/2006 Vits et al.
7,147,251 B2 12/2006 Bell et al.
D535,214 S 1/2007 Kolasa
7,159,285 B2 1/2007 Karlsson et al.
7,180,258 B2 2/2007 Specht et al.
7,182,370 B2 2/2007 Arnold
7,210,707 B2 5/2007 Schroth et al.
7,216,827 B2 5/2007 Tanaka et al.
7,219,929 B2 5/2007 Bell et al.
7,232,154 B2 6/2007 Desmarais et al.
7,237,741 B2 7/2007 Specht et al.
7,240,405 B2 7/2007 Webber et al.
7,240,924 B2 7/2007 Kohlndorfer et al.
7,246,854 B2 7/2007 Dingman et al.
7,263,750 B2 9/2007 Keene et al.
7,278,684 B2 10/2007 Boyle
D555,358 S 11/2007 King
7,300,013 B2 11/2007 Morgan et al.
7,341,216 B2 3/2008 Heckmayr et al.
7,360,287 B2 4/2008 Cerruti et al.
7,367,590 B2 5/2008 Koning et al.
7,377,464 B2 5/2008 Morgan
7,384,014 B2 6/2008 Ver Hoven et al.
7,395,585 B2 7/2008 Longley et al.
7,404,239 B1 7/2008 Walton et al.
7,407,193 B2 8/2008 Yamaguchi et al.
D578,931 S 10/2008 Toltzman et al.
7,452,003 B2 11/2008 Bell
7,455,256 B2 11/2008 Morgan
7,461,866 B2 12/2008 Desmarais et al.
7,475,840 B2 1/2009 Heckmayr
7,477,139 B1 1/2009 Cuevas
7,481,399 B2 1/2009 Nohren et al.
7,506,413 B2 3/2009 Dingman et al.
7,516,808 B2 4/2009 Tanaka
7,520,036 B1 4/2009 Baldwin et al.
D592,543 S 5/2009 Kolasa
D592,830 S 5/2009 Whiteside
7,533,902 B2 5/2009 Arnold et al.
7,547,043 B2 6/2009 Kokeguchi et al.
7,614,124 B2 11/2009 Keene et al.
7,631,830 B2 12/2009 Boelstler et al.
7,669,794 B2 3/2010 Boelstler et al.
7,673,945 B1 3/2010 Riffel et al.
7,698,791 B2 4/2010 Pezza
7,722,081 B2 5/2010 Van Druff et al.

(56) References Cited

U.S. PATENT DOCUMENTS

| | | | | |
|---|---|---|---|---|
| 7,739,019 | B2 | 6/2010 | Robert et al. | |
| 7,753,410 | B2 | 7/2010 | Coultrup | |
| 7,775,557 | B2 | 8/2010 | Bostrom et al. | |
| 7,794,024 | B1 * | 9/2010 | Kranz et al. | 297/484 |
| RE41,790 | E | 10/2010 | Stanley | |
| 7,861,341 | B2 | 1/2011 | Ayette et al. | |
| 7,862,124 | B2 | 1/2011 | Dingman | |
| D632,611 | S | 2/2011 | Buscart | |
| D637,518 | S | 5/2011 | Chen | |
| 7,934,775 | B2 | 5/2011 | Walker et al. | |
| 7,945,975 | B2 | 5/2011 | Thomas et al. | |
| 8,011,730 | B2 | 9/2011 | Greenwood | |
| 8,037,581 | B2 | 10/2011 | Gray et al. | |
| 8,096,027 | B2 | 1/2012 | Jung et al. | |
| 8,240,012 | B2 | 8/2012 | Walega et al. | |
| 8,240,767 | B2 | 8/2012 | Greenwood | |
| 8,256,073 | B2 * | 9/2012 | Zhang | 24/634 |
| 8,381,373 | B2 * | 2/2013 | Jung | 24/632 |
| 8,387,216 | B1 | 3/2013 | Martinson | |
| 8,468,660 | B2 * | 6/2013 | Holler | 24/632 |
| 8,567,022 | B2 | 10/2013 | Keene et al. | |
| 8,627,554 | B1 | 1/2014 | Hagan et al. | |
| 2002/0089163 | A1 | 7/2002 | Bedewi et al. | |
| 2002/0135175 | A1 | 9/2002 | Schroth | |
| 2002/0145279 | A1 | 10/2002 | Murray | |
| 2003/0015863 | A1 | 1/2003 | Brown et al. | |
| 2003/0027917 | A1 | 2/2003 | Namiki et al. | |
| 2003/0085608 | A1 | 5/2003 | Girardin | |
| 2004/0084953 | A1 | 5/2004 | Hansen | |
| 2004/0169411 | A1 | 9/2004 | Murray | |
| 2004/0174063 | A1 | 9/2004 | Kocher | |
| 2004/0217583 | A1 | 11/2004 | Wang | |
| 2004/0227390 | A1 | 11/2004 | Schroth | |
| 2004/0251367 | A1 | 12/2004 | Suzuki et al. | |
| 2005/0073187 | A1 | 4/2005 | Frank et al. | |
| 2005/0107932 | A1 | 5/2005 | Bolz et al. | |
| 2005/0127660 | A1 | 6/2005 | Liu | |
| 2005/0175253 | A1 | 8/2005 | Li et al. | |
| 2005/0179244 | A1 | 8/2005 | Schroth | |
| 2005/0206151 | A1 | 9/2005 | Ashline | |
| 2005/0284977 | A1 | 12/2005 | Specht et al. | |
| 2006/0071535 | A1 | 4/2006 | Kim et al. | |
| 2006/0075609 | A1 | 4/2006 | Dingman et al. | |
| 2006/0097095 | A1 | 5/2006 | Boast | |
| 2006/0237573 | A1 | 10/2006 | Boelstler et al. | |
| 2006/0243070 | A1 | 11/2006 | Van Druff et al. | |
| 2006/0267394 | A1 | 11/2006 | David et al. | |
| 2006/0277727 | A1 | 12/2006 | Keene et al. | |
| 2007/0080528 | A1 | 4/2007 | Itoga et al. | |
| 2007/0241549 | A1 | 10/2007 | Boelstler et al. | |
| 2007/0257480 | A1 | 11/2007 | Van Druff et al. | |
| 2008/0018156 | A1 | 1/2008 | Hammarskjold et al. | |
| 2008/0054615 | A1 | 3/2008 | Coultrup | |
| 2008/0093833 | A1 | 4/2008 | Odate | |
| 2008/0100051 | A1 | 5/2008 | Bell et al. | |
| 2008/0100122 | A1 | 5/2008 | Bell et al. | |
| 2008/0136246 | A1 | 6/2008 | Salter | |
| 2008/0172847 | A1 | 7/2008 | Keene et al. | |
| 2008/0224460 | A1 | 9/2008 | Erez | |
| 2009/0014991 | A1 | 1/2009 | Smyth et al. | |
| 2009/0069983 | A1 | 3/2009 | Humbert et al. | |
| 2009/0179412 | A1 | 7/2009 | Gray et al. | |
| 2009/0183348 | A1 | 7/2009 | Walton et al. | |
| 2009/0212549 | A1 | 8/2009 | Jones | |
| 2009/0241305 | A1 | 10/2009 | Buckingham | |
| 2010/0046843 | A1 | 2/2010 | Ma et al. | |
| 2010/0115737 | A1 | 5/2010 | Foubert | |
| 2010/0125983 | A1 | 5/2010 | Keene et al. | |
| 2010/0146749 | A1 | 6/2010 | Jung | |
| 2010/0213753 | A1 | 8/2010 | Humbert | |
| 2010/0219667 | A1 | 9/2010 | Merrill et al. | |
| 2011/0010901 | A1 | 1/2011 | Holler | |
| 2011/0043402 | A1 | 2/2011 | Sasakawa | |
| 2011/0057500 | A1 | 3/2011 | Walker et al. | |
| 2011/0162175 | A1 * | 7/2011 | Gnesda et al. | 24/593.1 |
| 2012/0242134 | A1 | 9/2012 | Siegel | |
| 2012/0292893 | A1 | 11/2012 | Baca et al. | |
| 2013/0127229 | A1 | 5/2013 | Humbert | |

FOREIGN PATENT DOCUMENTS

| | | |
|---|---|---|
| CA | 2112960 | 7/1994 |
| CA | 2450744 | 2/2003 |
| DE | 4019402 | 12/1991 |
| DE | 4421688 | 12/1995 |
| DE | 69019765 | 2/1996 |
| EP | 26564 | 4/1981 |
| EP | 0363062 | 4/1990 |
| EP | 0380442 | 8/1990 |
| EP | 0401455 | 12/1990 |
| EP | 0404730 | 12/1990 |
| EP | 0449772 | 10/1991 |
| EP | 0519296 | 12/1992 |
| EP | 0561274 | 9/1993 |
| EP | 0608564 | 8/1994 |
| EP | 1153789 | 11/2001 |
| EP | 1447021 | 8/2004 |
| FR | 1298012 | 7/1962 |
| GB | 888436 | 1/1962 |
| GB | 1047761 | 11/1966 |
| GB | 1582973 | 1/1981 |
| GB | 2055952 | 3/1981 |
| GB | 2356890 | 6/2001 |
| JP | 52055120 | 5/1977 |
| JP | 63141852 U | 9/1988 |
| JP | 63247150 | 10/1988 |
| JP | 10119611 | 5/1998 |
| JP | 2001138858 | 5/2001 |
| WO | WO-8603386 | 6/1986 |
| WO | WO-03009717 | 2/2003 |
| WO | WO-2004004507 | 1/2004 |
| WO | WO-2006041859 | 4/2006 |
| WO | WO-2010/027853 | 3/2010 |

OTHER PUBLICATIONS

Global Seating Systems LLC, "CCOPS," Cobra: Soldier Survival System, 1 page, undated.

Holmbergs, "Art.No. 63-4959-XX and 63-4958-XX GR.1 Buckle, 3/5 point." Accessed Sep. 15, 2010. www.holmbergs.se. (2 pages).

Holmbergs, "Gr. 0+ 3-point buckle with plastic chassi and tongues." Accessed Sep. 15, 2010. www.holmbergs.se. (1 page).

Holmbergs, "Gr. 1 Buckle, Viking." Accessed Sep. 15, 2010. www.holmbergs.se. (1 page).

Holmbergs, "Group 1 Systems." Accessed Sep. 15, 2010. www.holmbergs.se. (1 page).

Holmbergs, "Infant buckle with steel tongues." Accessed Sep. 15, 2010. www.holmbergs.se. (1 page).

Holmbergs, "Infant buckle. 5-point with plastic chassi and plastic tongues." Accessed Sep. 15, 2010. www.holmbergs.se. (1 page).

Novarace, "DL: Group 1 Buckle." Accessed Sep. 15, 2010. www.novarace.com. (1 page).

Novarace, "GT 3: Group 0 Buckle." Accessed Sep. 15, 2010. www.novarace.com (1 page).

Novarace, "GT 5: Group 0 Buckle." Accessed Sep. 15, 2010. www.novarace.com (1 page).

Novarace, "GT: Group 1 Buckle." Accessed Oct. 8, 2010. www.novarace.com. (1 page).

Novarace, "KMA 1: Group 1 Buckle." Accessed Sep. 15, 2010. www.novarace.com. (1 page).

Sabelt Catalog, "SAB104: Standard tongue hole to facilitate webbing insert," p. 23 (1 page).

Sabelt, "Daphne 0: Fiberglass-plastic buckle with metal pin latch." Accessed Sep. 15, 2010. www.sabelt.com (1 page).

Sabelt, "RO1000: Fiberglass-plastic buckle with metal pin latch." Accessed Sep. 15, 2010. www.sabelt.com (1 page).

Sabelt, "SAB004: Fiberglass-plastic buckle with metal pin latch." Accessed Sep. 15, 2010. www.sabelt.com. (1 page).

(56) References Cited

OTHER PUBLICATIONS

Sabelt, "SABUSA004: Fiberglass-plastic buckle with metal pin latch." Accessed Sep. 15, 2010. www.sabelt.com. (1 page).

Schroth Safety Products, Installation Instructions, HMMWV Gunner restraint, Single Lower with Swivel—M1151, Revision: A, Jul. 28, 2006, pp. 1-10.

Toltzman, Randall and Shaul, Rich; "Buckle Assembly"; U.S. Appl. No. 29/297,210, filed Nov. 6, 2007, electronic copy located at www.uspto.gov.

"ExxonMObil Santoprene 221-55 Thermoplastic Elastomer" materials sheet. Retrieved from http://www.matweb.com/search/datasheet.aspx?matguid=67de0de851854bb085afcfac35e294f5&ckck=1 on Jul. 8, 2013.

ASTM D395-03 (Reapproved 2008) "Standard Test Methods for Rubber Property—Compression Set", Retreived from http://enterprise2.astm.org/DOWNLOAD/D395.1656713-1.pdf on Jul. 9, 2013.

International Search Report and Written Opinion dated Jun. 5, 2014; International Application No. PCT/US2014/016995; 7 pages.

* cited by examiner

BUCKLE ASSEMBLIES WITH LIFT LATCHES AND ASSOCIATED METHODS AND SYSTEMS

TECHNICAL FIELD

The following disclosure relates generally to personal restraint systems for use in vehicles and, more particularly, to buckle assemblies having lift latch features and associated methods and systems.

BACKGROUND

There are many types of personal restraint systems for use in automobiles, aircraft, all-terrain vehicles, and other vehicles. Such systems include, for example, seat belts for use by adults and children of sufficient sizes, and child seats with associated restraints for use by toddlers and small children. Methods of securing seat belts or webs around an occupant in a vehicle or an aircraft include releasably attaching an end portion of each of the belts or webs to a buckle assembly. The buckle assembly retains the belts or webs around the occupant so as to secure the occupant on a seat of the vehicle or aircraft. The occupant can release the belts or webs from the buckle assembly when he or she wants to leave the seat.

Conventional buckle assemblies can be positioned to the side of or in front of an occupant. For example, a "three-point" harness system, as typically found in conventional automobiles, can include a shoulder web and a lap web that are releasably secured to a buckle assembly positioned proximate to the occupant's lower body. A "five-point" harness system can include a crotch web, first and second shoulder webs, and first and second lap webs that are releasably secured to a buckle assembly positioned proximate to the occupant's mid-section. Conventional buckle assemblies for such five-point harnesses include a push button or rotary-style release feature to disengage the webs from the buckle assembly. However, especially under certain emergency circumstances, releasing the buckle assembly by rotation or pushing buttons can be difficult for some occupants.

DETAILED DESCRIPTION

The following disclosure describes various embodiments of buckle assemblies with lift latch features and associated systems and methods. Advantages of embodiments of the buckle assemblies described in the present disclosure include improving safety for occupants in vehicles by providing a relatively quick and easy way to release the buckle assemblies. Other advantages of embodiments include providing buckle assemblies with lift latches features that allow occupants in vehicles to release the buckle assemblies by one single action.

As described in greater detail below, a personal restraint system configured in accordance with one aspect of the disclosure can include a buckle assembly that can be released by operating a lift latch. Certain details are set forth in the following description and in FIGS. 1-5 to provide a thorough understanding of various embodiments of the present disclosure. However, other details describing well-known structures and systems often associated with buckle assemblies and/or other aspects of personal restraint systems are not set forth below to avoid unnecessarily obscuring the description of various embodiments of the present disclosure.

Many of the details, dimensions, angles, and other features shown in the Figures are merely illustrative of particular embodiments of the disclosure. Accordingly, other embodiments can have other details, dimensions, angles, and features without departing from the scope of the present disclosure. In addition, those of ordinary skill in the art will appreciate that further embodiments of the present disclosure can be practiced without several of the details described below. In the Figures, identical reference numbers identify identical or at least generally similar elements.

Figure 1:
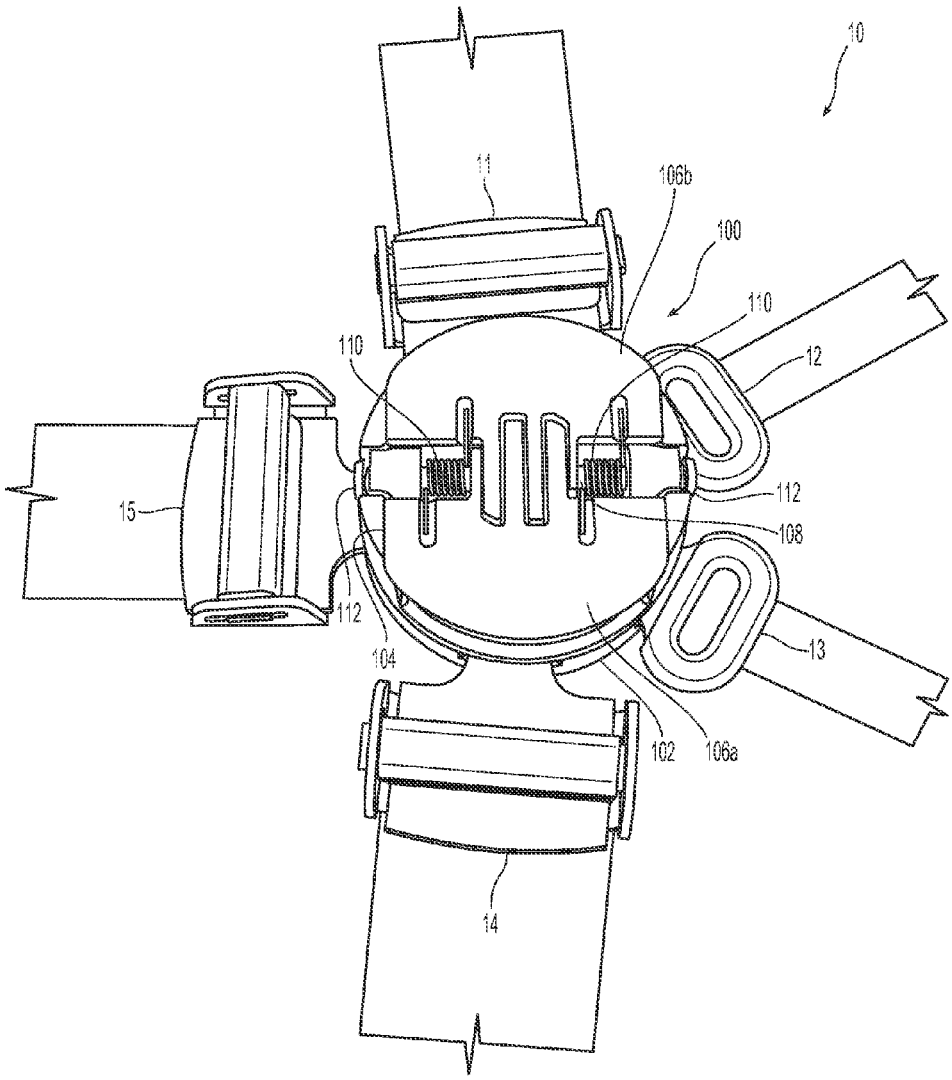
FIG. 1 is an isometric view of a portion of a personal restraint system in accordance with an embodiment of the present disclosure.

FIG. 1 is an isometric view of a portion of a personal restraint system 10 configured in accordance with an embodiment of the present disclosure. In the illustrated embodiment, the personal restraint system 10 includes a buckle assembly 100 that can be operably coupled to multiple belts or webs (not shown) via five connectors or latch plates 11, 12, 13, 14, and 15. In other embodiments, the number of latch plates can vary depending on different designs or arrangements, etc. In the illustrated embodiment, the buckle assembly 100 includes five corresponding openings (see FIGS. 2A and 2C below) to receive the five latch plates 11-15. The latch plates 11-15 can be formed with apertures (not shown) configured to cooperate with corresponding locking components (e.g., pawls 404 shown in FIG. 4 and discussed below) of the buckle assembly 100, so as to releasably engage the latch plates 11-15 with the buckle assembly 100.

The buckle assembly 100 can be connected via the latch plates 11-15 to individual webs or belts (not shown in FIG. 1), which can be fastened to individual fixed points within the vehicle (e.g., land vehicle, aircraft, or watercraft, etc) such that the occupant can be safely restrained in his or her seat. In other embodiments, however, the distal ends of the webs or belts can be operably coupled to one or more retractors (e.g., inertial reels) to provide adjustable lengths of the webs or the belts and/or pretensioning. One of ordinary skill in the art will appreciate that the restraint system 10 can be used with any types of vehicles including, for example, automobiles, military vehicles, aircraft, rotorcraft, watercraft, racing vehicles, etc. Moreover, the buckle assembly 100 described herein can be used with any types of restraint systems, including, for example, personal restraints, automobile restraints, aircraft restraints, racing restraints, child restraints, parachute restraints, fall-protection restraints, aviation tie down restraints, etc.

The buckle assembly 100 can include a bottom housing portion 102, a cover portion 104, lift latches 106 (exemplified individually as a lift latch 106*a* and a second lift latch 106*b*), a pivot shaft 108, torsion springs 110 and shaft caps 112. In the illustrated embodiment, the bottom housing portion 102 can be affixed to the cover 104. The lift latches 106 can be pivotally coupled to the shaft 108. Vehicle occupants can lift one of the lift latches 106 to release the buckle assembly 100. In the illustrated embodiment, each lift latch 106 is operably coupled to a corresponding torsion spring 110. The torsion springs 110 can return the lift latches 106 back to their original locations (see details below). As shown in the illustrated embodiment, the shaft 108 can be covered by shaft caps 112 at two ends. The shaft caps 112 can secure the shaft 108 to the cover 104 and protect the shaft 108 from damage by accidental impacts. In certain embodiments, the shaft caps 112 can include a retaining ring, a pin, or any other suitable devices to hold them in place.

Figure 2A:
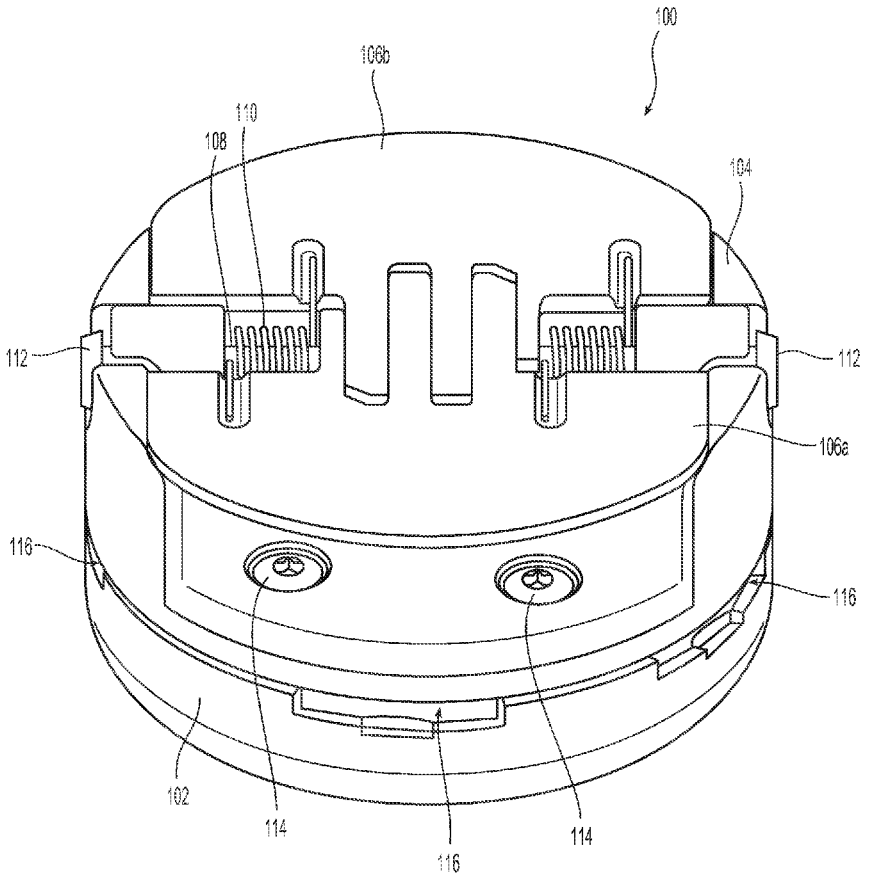
FIG. 2A is an isometric view of the buckle assembly shown in FIG. 1.

FIG. 2A is an enlarged isometric view of the buckle assembly 100 shown in FIG. 1. In the illustrated embodiment, the bottom housing portion 102 and the cover portion 104 can be affixed or secured by the bolts 114. In other embodiments, the bottom housing portion 102 can be affixed to the cover portion 104 by snaps, glue, or other suitable means. As shown in FIG. 2A, the bottom housing portion 102 can be formed with five openings 116 (not all openings 116 are shown in FIG. 2A) for receiving and engaging the latch plates 11-15. In certain embodiments, the openings 116 can be collectively formed by the bottom housing 102 and the cover 104. In other embodiments, the openings 116 can be formed in the cover 104.

As shown in FIG. 2A, the shaft 108 passes through the cover 104, the lift latches 106, and the torsion springs 110. The lift latches 106 can be operably rotated around the shaft 108. In FIG. 2A, the lift latches 106 are shown at initial positions. Namely, a vehicle occupant is either secured in his or her seat (i.e., all or a portion of the latch plates 11-15 are inserted and secured in the corresponding openings 116), or the buckle assembly 100 is not in operation (i.e., the latch plates 11-15 have not been inserted in or have been removed from the corresponding openings 116). When the occupant lifts one of the lift latches 106 (i.e., rotating one of the lift latches 106 around the shaft 108) to a release position (not shown in FIG. 2A), the secured latch plates 11-15 can be removed from the buckle assembly 100 to release the occupant.

Figure 2B:
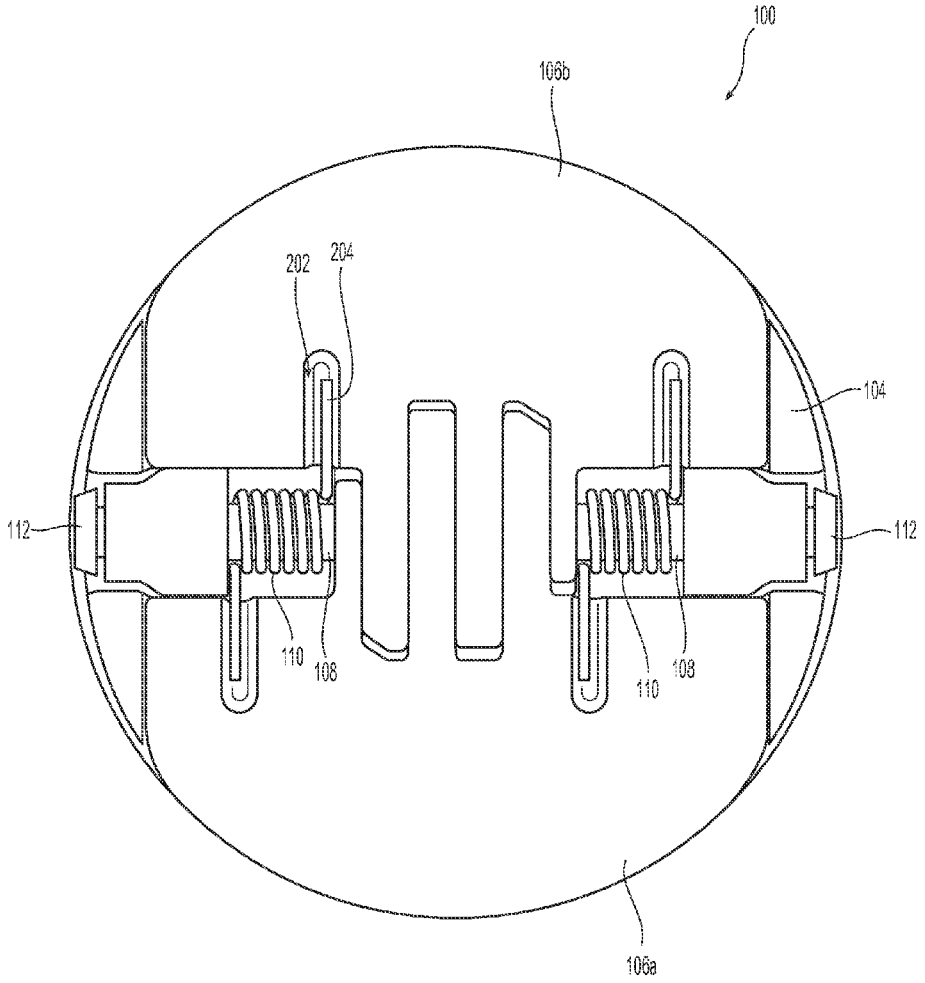
FIG. 2B is a top view of the buckle assembly shown in FIG. 2A.

FIG. 2B is a top view of the buckle assembly 100 shown in FIG. 2A. In the illustrated embodiment, the lift latches 106 can be positioned on opposite sides of the buckle assembly 100, and formed as shapes complementary to each other such that they can collectively define the top surface of the buckle assembly 100. In other embodiments, the lift latches 106 can have different shapes as long as they can be rotated without hindrance or interference by each other. As shown in FIG. 2B, the lift latch 106 can be formed with a recess 202 to accommodate an elongated end portion 204 of the torsion spring 110. In certain embodiments, the recess 202 facilitates securing the torsion spring 110. In other embodiments, the lift latch 106 and the torsion spring 110 can be integrally formed (e.g., the lift latch 106 can have a resilient portion that functions as the torsion spring 110).

Figure 2C:
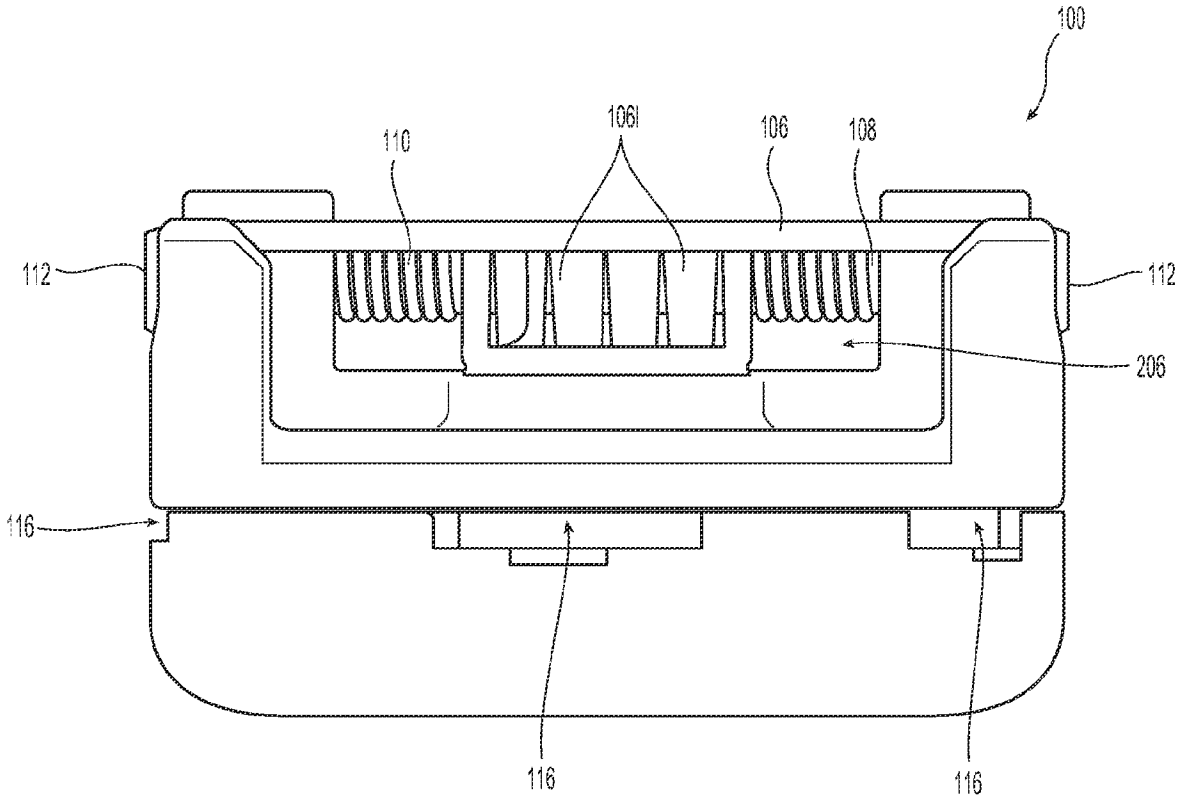
FIG. 2C is a side view of the buckle assembly shown in FIG. 2A.

FIG. 2C is a side view of the buckle assembly shown in FIG. 2A. In the illustrated embodiment, the cover 104 can define an operating space 206 that allows the lift latch 106 to rotate around the shaft 108. As shown in FIG. 2C, the lift latch 106 can further include a cam portion 1061. When an occupant lifts one of the lift latches 106 to the release position (not shown in FIG. 2C), the cam portion 1061 can rotate or move corresponding components (e.g., the lifter 402 shown in FIG. 4, as discussed below) to release the inserted and secured latch plates 11-15.

Figure 3:
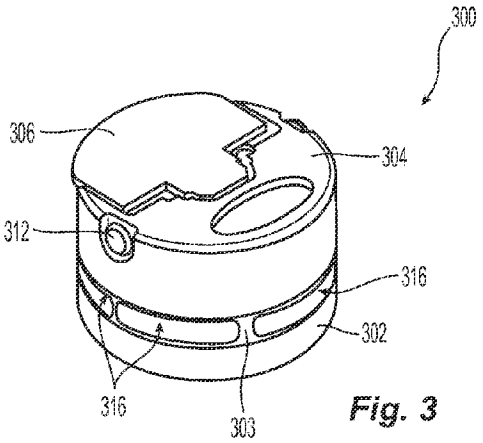
FIG. 3 is an isometric view of a buckle assembly configured in accordance with another embodiment of the present disclosure.

FIG. 3 is an isometric view of a buckle assembly 300 configured in accordance with another embodiment of the present disclosure. In the illustrated embodiment, the buckle assembly 300 can include a bottom housing 302, a load plate 303, a cover 304, a lift latch 306 and shaft caps 312. In the illustrated embodiment, the bottom housing 302 can be affixed to the cover 304 by the load plate 303. As shown in FIG. 3, the load plate can be formed with multiple openings 316 to accommodate corresponding latch plates (e.g., the latch plates 11-15 in FIG. 1).

Figure 4:
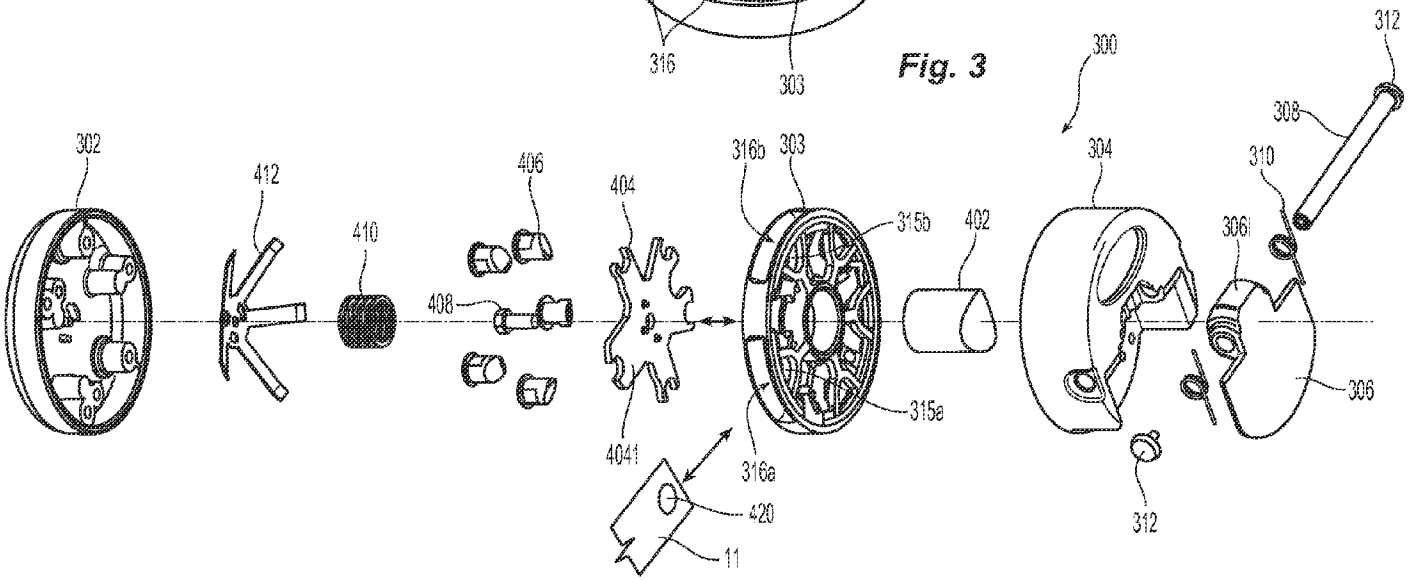
FIG. 4 is an exploded isometric view of the buckle assembly shown in FIG. 3.

FIG. 4 is an exploded isometric view of the buckle assembly 300 of FIG. 3. In the illustrated embodiment, the buckle assembly 300 includes a shaft 308, torsion springs 310, a lifter 402, an actuator 404, pawls 406, a screw 408, a center actuation spring 410, and a pawl spring 412. In the illustrated embodiment, the load plate 303 can be positioned between the cover 304 and the bottom housing 302. In this embodiment, the apertures 315 adjacent to the openings 316 formed in the load plate 303 accommodate the pawls 406. As discussed above, when the individual latch plates 11-15 are inserted in the openings 316, the pawls 406 can secure the inserted latch plates by moving into the corresponding center holes 420 of the latch plates 11-15.

Referring to FIG. 4, the shaft 308 passes through the torsion springs 310, the lift latch 306, and the cover 304. In the embodiment shown in FIGS. 3 and 4, the lift latch 306 can be operably rotated around the shaft 308. The lift latch 306 can further include a cam portion 3061. In operation, the cam portion 3061 contacts the lifter 402, which is affixed to the actuator 404 by the screw 408. In the illustrated embodiment, the actuator 404 can be a plate with five protrusions 4041 that correspond to the five pawls 406 shown in FIG. 4. In other embodiments, the buckle assembly 300 can have a different number of pawls 406 and corresponding protrusions 4041 of the actuator 404. In the illustrated embodiment, the pawls 406 are supported by the pawl spring 412, and the actuator 404 is supported by the center actuation spring 410. The pawl spring 412 and the actuation spring 410 provide resilient biasing forces to the pawls 406 and the actuator 404 respectively, to bias the pawls 406 and the actuator 404 upwardly toward the cover 304 (locking positions or closed positions) when the lift latch 306 is at its initial position, as shown in FIG. 3.

When the lift latch 306 is at the initial position (e.g., as shown in FIG. 3), a vehicle occupant can be secured in his or her seat by inserting the latch plates 11-15 in the corresponding openings 316. When the occupant lifts or rotates the lift latch 306 about the shaft 312 to a release position (not shown in FIG. 3), the cam portion 3061 pushes downwardly or moves the lifter 402 toward the bottom housing 302. The lifter 402 then drives the actuator 404 against the pawl flanges to move the pawls 406 toward the bottom housing 302 and therefore withdraw the distal ends of the pawls 406 from the apertures 420 in the latch plates 11-15. As a result, the inserted and secured latch plates 11-15 can be released from the buckle assembly 300, such that the occupant can leave from his or her seat. When the lift latch 306 returns to the initial position from the release position, the torsion spring 310 provides a resilient force to drive the lift latches 306 back to the initial position. Meanwhile, the pawl spring 412 and the center actuation spring 410 can also provide resilient forces to drive the pawls 406 and the actuator 404 respectively, upwardly toward back to locked positions.

In certain embodiments, the lift latch 306 can move the actuator 404 by a linkage member (not shown in Figures) or by a pivoting jack member. For example, when the occupant lifts the lift latch 306, the lift latch 306 can move the linkage member to cause the actuator 404 to move the pawls 406 toward the bottom housing 302. In other embodiments, the lift latch 306 can move the actuator 404 by a pivoting jack system (not shown in Figures). In other embodiments, lifting the lift latch 306 can rotate the lifter 402 about is axis, and the lifter 402 can include a lower cam surface that cooperates with a corresponding cam surface of the actuator 404 to move the actuator 404 downwardly toward the bottom housing 302. The lifter 402 can have an upper cam surface (not shown) that contacts a corresponding surface of the cam portion 3061. When the lift latch 306 is lifted, the cam portion 3061 can rotate the lifter 402 via the contoured surface. Once the lifter 402 is rotated, the actuator 404 can be moved downwardly and the pawls 406 pushed back toward the bottom housing 302. As a result, the latch plates 11-15 can be released from the buckle assembly 300. One of ordinary skill in the art would know that the latch plates 11-15 can be inserted into the openings 316 by any random order. In addition, the number of the latch plates can vary depending on different designs or suitable arrangements.

Figure 5A:
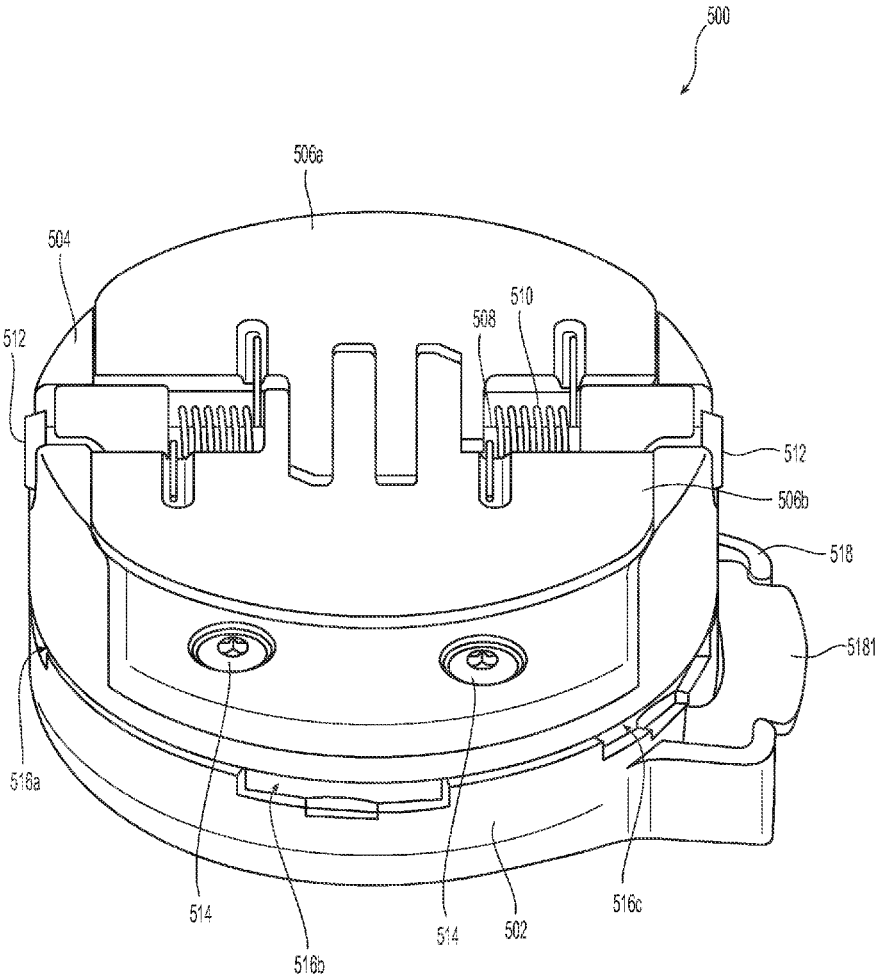
FIG. 5A is an isometric view of a buckle assembly configured in accordance with yet another embodiment of the present disclosure.

FIG. 5A is an isometric view of a buckle assembly 500 configured in accordance with yet another embodiment of the present disclosure. One difference between the embodiments shown in FIG. 2A and FIG. 5A is that the buckle assembly 500 shown in FIG. 5A includes an additional locking device 518 formed within a bottom housing 502. In the illustrated embodiment shown in FIG. 5A, the buckle assembly 500 can include the bottom housing 502, a cover 504, lift latches 506, a shaft 508, torsion springs 510, shaft caps 512, bolts 514 and the additional locking device 518. In this embodiment, the bottom housing 502 is affixed to the cover 504 by the bolts 514.

As shown in FIG. 5A, the housing 502 can be formed with multiple web connectors or latch plate openings 516*a-c* (not all openings 516 are shown in FIG. 5A) and the locking device 518, so as to accommodate multiple latch plates (including the latch plates 11-15). The locking device 518 can accommodate a latch plate and function independently from other openings 516. The additional locking device 518 can also include a separate lift latch 5181 to release the latch plate inserted in the opening 516*c* and engaged by the locking device 518. In other words, lifting one or both of the lift latches 506 does not release the latch plate inserted in the opening 516*c* that is engaged of the locking device 518. The embodiments described in FIG. 5A provide flexibility of designs. For example, when the occupant wants to be released from the seat during an emergency, the buckle assembly 500 can remain attached to the harness by the additional locking device 518.

Figure 5B:
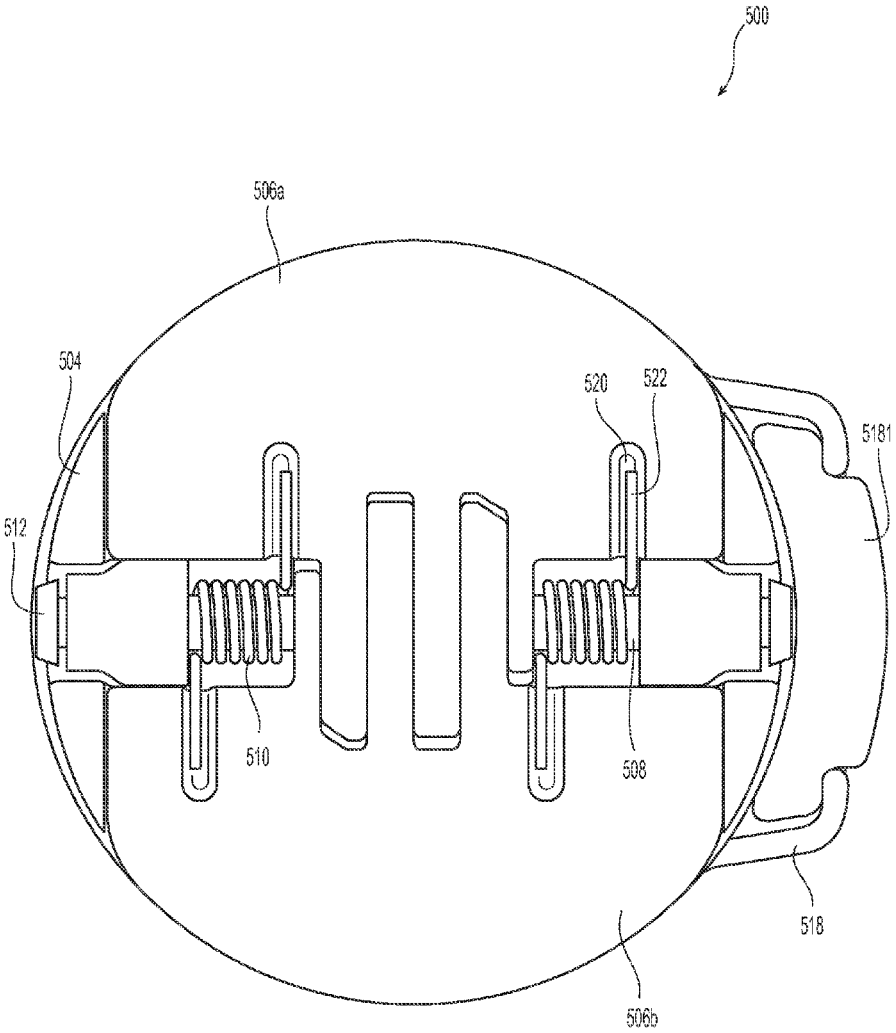
FIG. 5B is a top view of the buckle assembly shown in FIG. 5A.

FIG. 5B is a top view of the buckle assembly 500 shown in FIG. 5A. In the illustrated embodiment, lift latches 506 can be positioned on opposite sides of the buckle assembly 500. The two lift latches 106 can be formed as shapes complementary to each other that they can collectively define the top surface of the buckle assembly 500. As shown in FIG. 5B, the lift latch 506 can be formed with a recess 520 to accommodate an elongated portion 522 of the torsion spring 510. In certain embodiments, the recess 520 can facilitate securing the torsion spring 510 with the lift latch 506. In other embodiments, the lift latch 506 and the torsion spring 510 can be formed integrally.

Figure 5C:
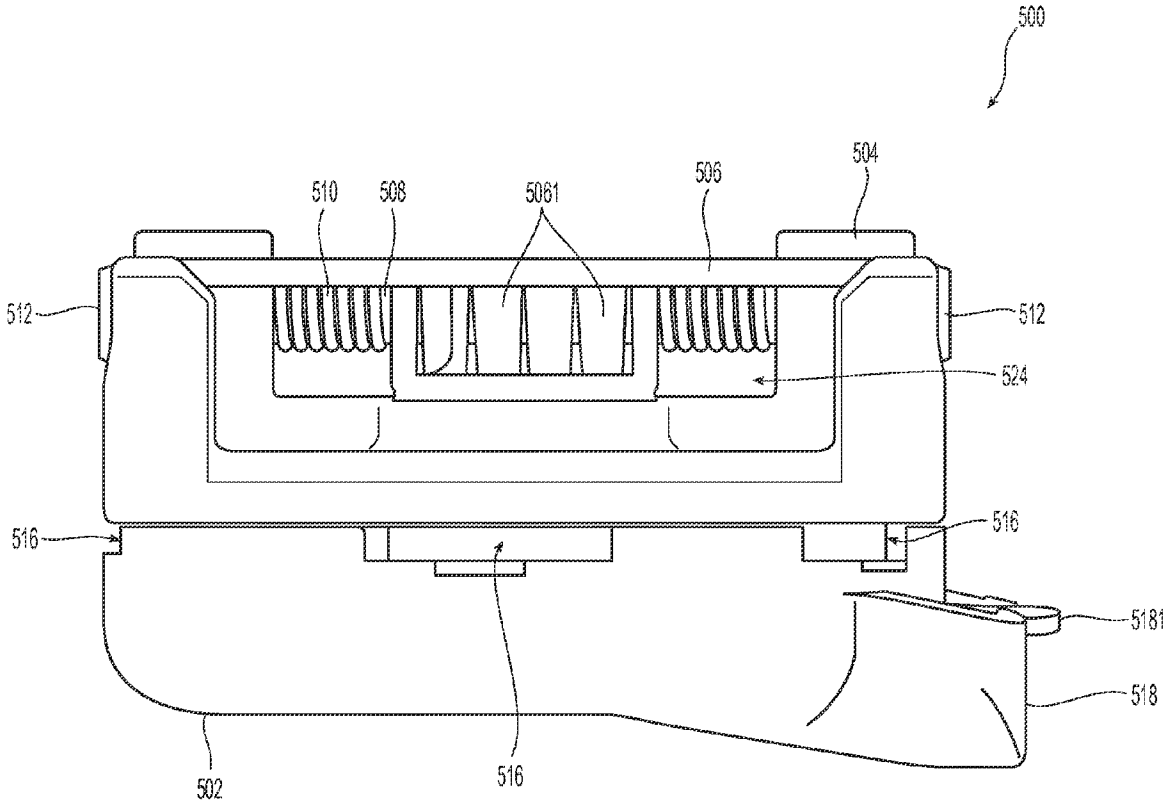
FIG. 5C is a side view of the buckle assembly shown in FIG. 5A.

FIG. 5C is a side view of the buckle assembly 500 shown in FIG. 5A. In the illustrated embodiment, the cover 504 can be formed with an operating space 524 to provide a space for the lift latch 506 to rotate around the shaft 508. As shown in FIG. 5C, the lift latch 506 can further include a cam portion 5061. The cam portion 5061 can function similarly to the cam portion 3061 as discussed above with respect to FIGS. 3 and 4 above.

The buckle assemblies 100, 300, and 500 described in the present disclosure can be connected with a computer system (not shown) of a vehicle. In certain embodiments, the computer system of the vehicle can monitor the status of the buckle assemblies 100, 300, and 500 (e.g., whether the inserted latch plates are secured properly) and take appropriate action. For example, when the computer system detects an abnormal situation (e.g., an unexpected impact, the system can notify the occupant who is currently using the buckle assembly, or alternatively, the system can automatically lock or release the buckle assembly. The computer system described in the present disclosure can include a center processing unit (CPU) configured to process a set of computer readable instructions, a memory configured to temporarily store the same instructions, and a storage device configured to store the same instructions and other related information.

From the foregoing, it will be appreciated that specific embodiments of the disclosure have been described herein for purposes of illustration, but that various modifications may be made without deviating from the spirit and scope of the various embodiments of the disclosure. Further, while various advantages associated with certain embodiments of the disclosure have been described above in the context of those embodiments, other embodiments may also exhibit such advantages, and not all embodiments need necessarily exhibit such advantages to fall within the scope of the invention. The following examples are directed to embodiments of the present disclosure.

We claim:

1. A buckle assembly, comprising:

a cover;

a plurality of openings positioned circumferentially adjacent to the cover, wherein each of the openings is configured to receive a corresponding latch plate coupled to a web of a personal restraint system;

a plurality of pawls, wherein each of the pawls is configured to selectively engage a corresponding one of the latch plates, when the latch plates are inserted into the openings;

a lift latch having a cam portion and configured to be operably rotated relative to the cover;

a lifter configured to cooperate with the cam portion;

an actuator operably coupled to the lifter and configured to disengage the pawls from the latch plates and release the latch plates from the openings in response to rotation of the lift latch;

wherein the lift latch is a first lift latch configured to be operably rotated relative to the cover to release the latch plates from the openings, and wherein the buckle assembly further comprises a second lift latch positioned opposite the first lift latch and configured to be operably rotated relative to the cover to release the latch plates from the openings.

2. A buckle assembly, comprising:

a cover;

a plurality of openings positioned circumferentially adjacent to the cover, wherein each of the openings is configured to receive a corresponding latch plate coupled to a web of a personal restraint system;

a plurality of pawls, wherein each of the pawls is configured to selectively engage a corresponding one of the latch plates, when the latch plates are inserted into the openings;

a lift latch having a cam portion and configured to be operably rotated relative to the cover;

a lifter configured to cooperate with the cam portion;

an actuator operably coupled to the lifter and configured to disengage the pawls from the latch plates and release the latch plates from the openings in response to rotation of the lift latch;

a bottom housing; and a load plate disposed between the bottom housing and the cover, wherein the plurality of openings are circumferentially positioned around the load plate, and wherein the load plate includes a plurality of apertures configured to receive the pawls.

3. The buckle assembly of claim 2, further comprising a secondary opening positioned in the bottom housing and configured to receive a corresponding secondary latch plate coupled to a secondary web of the personal restraint system.

4. A buckle assembly, comprising:

a cover;

a plurality of openings positioned circumferentially adjacent to the cover, wherein each of the openings is configured to receive a corresponding latch plate coupled to a web of a personal restraint system;

a plurality of pawls, wherein each of the pawls is configured to selectively engage a corresponding one of the latch plates, when the latch plates are inserted into the openings;

a lift latch having a cam portion and configured to be operably rotated relative to the cover;

a lifter configured to cooperate with the cam portion;

an actuator operably coupled to the lifter and configured to disengage the pawls from the latch plates and release the latch plates from the openings in response to rotation of the lift latch;

a pawl spring including a plurality of end portions, wherein each of the end portions biases a corresponding one of the pawls toward the cover.

5. The buckle assembly of claim 4, wherein the pawl spring includes a base portion, and wherein the end portions extend radially outward from the base portion.

6. The buckle assembly of claim 4, further comprising a center actuation spring positioned adjacent to the actuator and the pawl spring, wherein the center actuation spring biases the actuator toward the cover.

7. The buckle assembly of claim 4, wherein the cam portion drives the lifter toward the actuator when the lift latch is rotated relative to the cover.

8. The buckle assembly of claim 4, wherein the actuator includes a base portion and a plurality of protrusions positioned circumferentially around the base portion, wherein each of the protrusions includes a cutout configured to engage a corresponding one of the pawls.

9. A buckle assembly, comprising:

a cover;

a load plate positioned adjacent to the cover;

a plurality of openings positioned circumferentially around the load plate, wherein each of the openings is configured to receive a corresponding latch plate coupled to a web of a personal restraint system;

a plurality of pawls configured to selectively engage corresponding latch plates inserted into the openings;

a first lift latch configured to be operably rotated relative to the cover in a first direction;

a second lift latch positioned opposite the first lift latch and configured to be operably rotated relative to the cover in a second direction opposite the first direction; and a lifter cooperatively coupling the first and second lift latches to the pawls, wherein rotation of the first lift latch or the second lift latch relative to the cover releasably disengages the pawls from the latch plates.

10. The buckle assembly of claim 9, wherein the load plate includes a center opening, and wherein at least a portion of the lifter is operably positioned in the center opening.

11. The buckle assembly of claim 9, wherein the load plate includes:

a plurality of center portions;

an inner ring portion coupled to the center portions, wherein the inner ring portion defines a center opening to at least partially receive the lifter; and an outer ring portion coupled to the center portions;

wherein the outer ring portion and the center portions collectively define the openings.

12. The buckle assembly of claim 11, wherein each of the center portions includes a Y-shaped portion.

13. The buckle assembly of claim 11, wherein the center portions are positioned circumferentially between the inner ring portion and the outer ring portion.

14. The buckle assembly of claim 9, further comprising:

a bottom housing; and a secondary opening positioned in the bottom housing and configured to receive a corresponding secondary latch plate coupled to a secondary web of the personal restraint system.

15. The buckle assembly of claim 14, wherein the secondary opening and the openings are positioned at different horizontal levels.

* * * * *